US005724844A

United States Patent [19]

Saeki

[11] Patent Number: 5,724,844

[45] Date of Patent: Mar. 10, 1998

[54] INNER GROOVED TUBE FORMING APPARATUS

[75] Inventor: Chikara Saeki, Hatano, Japan

[73] Assignee: Kabushiki Kaisha Kobe Seiko Sho, Kobe, Japan

[21] Appl. No.: 775,306

[22] Filed: Dec. 31, 1996

[30] Foreign Application Priority Data

Jan. 19, 1996 [JP] Japan ..... 8-007915

[51] Int. Cl.[6] ..... B31D 53/06

[52] U.S. Cl. ..... 72/75

[58] Field of Search ..... 72/68, 75, 77, 72/78

[56] References Cited

U.S. PATENT DOCUMENTS

| | | | |
|---|---|---|---|
| 1,440,527 | 1/1923 | Brinkman | 72/75 |
| 4,876,869 | 10/1989 | Saeki et al. . | |
| 5,526,663 | 6/1996 | Sauvonnet et al. | 72/75 |

OTHER PUBLICATIONS

Patent Abstracts of Japan, JP 2-11211, Jan. 16, 1990.

Patent Abstracts of Japan, JP 55-103215, Aug. 7, 1980.

*Primary Examiner*—Lowell A. Larson

*Attorney, Agent, or Firm*—Oblon, Spivak, McClelland, Maier & Neustadt, P.C.

[57] ABSTRACT

An inner grooved tube forming apparatus capable of manufacturing an inner grooved tube with a stable quality by reducing the weight of each member and improving the durability to allow high-speed rotation of a planetary ball die. A grooved plug 12 is fixed to the front end of a mandrel 11, and is in contact with the inner surface of a mother tube 10. Balls 13 are in contact with the outer surface of the mother tube 10. The balls 13 are accommodated inside a ball track retaining outer ring 14. A ball retainer 20 is provided inside the outer ring 14 to retain the balls 13. The outer ring 14 is fixed to a rotating shaft 19 by a cylinder 16 and a front cap 17. A bearing 21 is mounted inside the cylinder 16, and a support member 22 is rotatably supported through the bearing 21 to the cylinder 16. The outer ring 14 and the support member 22 are formed of ceramic, and the ball retainer 20 is formed of synthetic resin. Accordingly, the weight of the apparatus as a whole can be reduced, thus allowing high-speed rotation.

14 Claims, 2 Drawing Sheets

INNER GROOVED TUBE FORMING APPARATUS

BACKGROUND OF THE INVENTION

The present invention relates to an inner grooved tube forming apparatus for grooving an inner surface of a metal or alloy tube used in a heat exchanger or the like for an air conditioner or the like, and more particularly to an inner grooved tube forming apparatus which can manufacture an inner grooved tube with a stable quality to allow high-speed rotation for grooving and high durability of each member.

Conventionally, a copper or copper alloy tube is used for a heat transfer tube in a heat exchanger or the like for an air conditioner or the like. The inner surface of the heat transfer tube is grooved to improve a heat exchange efficiency. The grooving of the inner surface of the tube is carried out by first inserting a grooved plug into the tube, then pressing a wall of the tube between the grooved plug and pressing means provided outside the tube, and simultaneously drawing the tube. To reduce friction during drawing of the tube and prevent fracture of the tube, a so-called planetary ball die including balls, a ball track retaining outer ring, and a ball retainer is used to groove the inner surface of the tube. The ball die is rotated around the outer circumference of the tube and simultaneously presses the outer surface of the tube. The friction between the ball die and the outer surface of the tube is rolling friction, So that a frictional force during grooving is reduced to thereby prevent the fracture of the tube.

FIG. 4 is a sectional side view of an inner grooved tube forming apparatus in the prior art (Japanese Utility Model Publication NO. 63-47376) Referring to FIG. 4, a mandrel 11 is inserted in a mother tube 10. A grooved plug 12 is fixed to the front end of the mandrel 11, and is kept in contact with the inner surface of the mother tube 10. The grooved plug 12 is formed with a spiral groove. A plurality of balls 13 are kept in contact with the outer surface of the mother tube 10. The wall of the mother tube 10 is pressed between the balls 13 and the grooved plug 12, and the balls 13 are rotated about the axis of the mother tube 10. Simultaneously, the mother tube 10 is drawn in a moving direction (drawing direction) shown by an arrow 40, thereby forming a continuous groove on the inner surface of the mother tube 10. To this end, the groove of the grooved plug 12 has such a shape that the mother tube 10 is drawn in the direction of the arrow 40 in concert with rotation of the balls 13. That is, the spiral groove of the grooved plug 12 is transferred to the inner surface of the mother tube 10 by the pressure of the balls 13.

The balls 13 are accommodated inside a short cylindrical, ball track retaining outer ring (which will be hereinafter referred to simply as an outer ring) 14. The inner surface of the outer ring 14 is formed as a tapering ball track area 15. The ball track area 15 is inversely tapered, or is diverged in the direction of the arrow 40. The balls 13 are pressed on the ball track area 15 to ensure a radial position of each ball 13 in a radial direction of the mother tube 10. A cylinder 16 and a front cap 17 are provided to restrict movement of the outer ring 14 in an axial direction of the mother tube 10. The outer ring 14 is fixed through the cylinder 16 and the front cap 17 to a rotating shaft 19 by bolts 18. The rotating shaft 19 is driven by an electric motor or a hydraulic motor, for example, to rotate at high speeds. The rotation of the rotating shaft 19 brings about rotation of the bolts 18, the front cap 17, the cylinder 16, and the outer ring 14 as a unit about the axis of the mother tube 10. The rotation of the outer ring 14 brings about rotation of the balls 13 about the axis of the mother tube 10. Thus, the balls 13 pressed on the ball track area 15 are rotated about the axis of the mother tube 10 as rolling on the outer surface of the mother tube 10. A ball retainer 20 is provided inside the outer ring 14 to retain the balls 13 at equal intervals in a circumferential direction of the mother tube 10. The ball retainer 20 is in sliding contact with the balls 13 at a radial position outside of a rotation track of the center of each ball 13, that is, a radial position shifted from the center of each ball 13 toward the outer ring 14.

An angular contact ball bearing 21 is mounted inside the cylinder 16. The bearing 21 includes a plurality of balls 21*a* retained in a hollow portion 30 (30*a* and 30*b*). The hollow portion 30*b* on the side of the moving direction of the mother tube 10 has a diameter smaller than the diameter of each ball 21*a*, and is positioned radially nearer to the mother tube 10 than the hollow portion 30*a*. Assuming that the front end of the bearing 21 is on the side of the moving direction of the mother tube 10, the rear end of the bearing 21 is tilted so as to come away from the mother tube 10 during grooving owing to the above structure. A substantially cylindrical thrust support member 22 is rotatably supported through the bearing 21 to the cylinder 16. A ball contact area 23 is formed on the rear end surface of the thrust support member 22 on the side opposite to the direction of the arrow 40. The ball contact area 23 is kept in contact with the balls 13. Since the bearing 21 is tilted during grooving as mentioned above, the thrust support member 22 applies a force having a direction opposite to the moving direction of the mother tube 10 through the ball contact area 23 to the balls 13. The ball contact area 23 is inclined in the direction of the arrow 40 with respect to the radial direction of the mother tube 10. The inner diameter and the outer diameter of the thrust support member 22 and the inclination angle of the ball contact area 23 are set to proper values so that a contact point 24 of the ball contact area 23 to each ball 13 lies at a radial position shifted from the center of each ball 13 toward the mother tube 10.

A ringlike spacer 25 is inserted between the bearing 21 and the rotating shaft 19, and is engaged with the inner surface of the cylinder 16. By changing the axial length of the spacer 25, the axial mount position of the bearing 21 can be changed. Accordingly, the axial position of the thrust support member 22 can be changed to change the axial position of the ball contact area 23 of the support member 22. As a result, the contact point 24 between each ball 13 and the contact area 23 can be moved in the axial direction of the mother tube 10, and the contact position between each ball 13 and the tapering ball track area 15 can be accordingly changed. Accordingly, the distance between the axis of the mother tube 10 and each ball 13 can be changed to thereby adjust the pressure of each ball 13 to the mother tube 10. Further, the position of each ball 13 relative to the grooved plug 12 can be also changed. Thus, the inner surface of the mother tube 10 can be grooved with a proper wall thickness.

In the condition where the mother tube-10 is inserted in the forming apparatus, the balls 13 are retained inside the outer ring 14 by the mother tube 10. However, in the condition where the mother tube 10 is not inserted in the forming apparatus, no elements for retaining the balls 13 are present, so that the balls 13 may fall or play inside the outer ring 14. To prevent this problem, a guide cap 26 is fixed to the front cap 17 to prevent falling of the balls 13. Further, a lubricating oil is supplied from the side of the front cap 17 to the balls 13 and the bearing 21, and the oil is drained from an oil drain hole 27 formed in the rotating shaft 19.

Specifically, the oil is supplied to the balls 13 and the bearing 21 by using an oil circulating device (not shown) to forcibly spray the oil from the side of the front cap 17.

In operation, the mandrel 11 is first operated to insert the grooved plug 12 fixed to the front end of the mandrel 11 into the mother tube 10. Accordingly, the wall of the mother tube 10 is pressed between the grooved plug 12 inside of the tube 10 and the balls 13 outside of the tube 10. The rotating shaft 19 is rotated at high speeds in a direction shown by an arrow 28 by a driving device (not shown) to thereby rotate the front cap 17, the cylinder 16, and the outer ring 14 together about the axis of the mother tube 10. The rotation of the outer ring 14 allows the balls 13 to rotate about the axis of the mother tube 10. In this condition, the balls 13 are pressed by the ball track area 15 to press the outer surface of the mother tube 10. During rotation of the balls 13, the mother tube 10 is drawn in the direction of the arrow 40. As a result, the shape of the groove formed on the grooved plug 12 is transferred to the inner surface of the mother tube 10, and the diameter of the mother tube 10 is reduced by the pressure of the balls 13. In this manner, the inner surface of the mother tube 10 is grooved with its diameter reduced, and the mother tube 10 is moved in the drawing direction to thereby form a continuous groove on the inner surface of the mother tube 10.

However, the above forming apparatus in the prior art has the following problems. In recent years, a size reduction of the inner grooved tube has been required to further improve the performance of a heat exchanger, and it has also been required to stably manufacture the inner grooved tube at low costs with high productivity. To improve the productivity with the use of the planetary ball die, the rotating speed of the ball die must be increased to improve the grooving efficiency. In the grooving operation, a centrifugal force due to rotation and a thrust force due to drawing are applied in addition to a reaction force from the tube. These forces cause large limitations in the case of increasing the rotating speed.

In the conventional inner grooved tube forming apparatus, each member is formed of a material having a large specific gravity, such as alloy iron, cemented carbide, or brass. Accordingly, when the die is rotated at high speeds (40000 rpm or more), each member may be broken by the above-mentioned forces. Further, since a mass radius is large, it is difficult to maintain centering, causing the occurrence of local wearing of each member. Further, the quality of the product is unstable.

Of the above-mentioned forces, the centrifugal force is proportional to the rotating speed and the square of the mass radius. Therefore, each member must be reduced in size or weight to increase the rotating speed. The size reduction is difficult because of design limitation. Further, it is also difficult to reduce the weight of each member with its strength maintained, because of an increase in heat generated during grooving and an increase in frictional force during drawing of the tube in the case of rotating the ball die at high speeds. Thus, the prior art forming apparatus has problems on both the size reduction and the weight reduction.

SUMMARY OF THE INVENTION

It is accordingly an object of the present invention to provide an inner grooved tube forming apparatus which can manufacture an inner grooved tube with a stable quality by reducing the weight of each member and improving the durability to allow high-speed rotation of a planetary ball die.

According to the present invention, there is provided an inner grooved tube forming apparatus for grooving an inner surface of a mother tube 10, which comprises a grooved plug 12 adapted to be inserted into the mother tube 10; a ball track retaining outer ring 14 through which the mother tube 10 is inserted, the outer ring 14 having an inner surface formed as a ball track area 15; a plurality of balls 13 kept in contact with an outer surface of the mother tube 10 and the ball track area 15, and adapted to be rolled on the outer surface of the mother tube 10 as being rotated around the mother tube 10 by rotation of the outer ring 14, whereby a wall of the mother tube 10 is pressed between the balls 13 and the grooved plug 12 to transfer a shape of a groove formed on the grooved plug 12 to the inner surface of the mother tube 10; a ball retainer 20 accommodated in the outer ring 14, for retaining the balls 13 at a radial position outside of a rotation track of the center of each ball 13 in a radial direction of the mother tube 10; and a thrust support member 22 rotatably supported by a bearing 21 mounted inside the outer ring 14, the thrust support member 22 having a ball contact area 23 kept in contact with the balls 13, for applying to the balls 13 a force having a direction opposite to a moving direction of the mother tube 10; wherein the ball track area 15 is formed with a first groove 61 extending in a circumferential direction of the mother tube 10, a radius of curvature of the first groove 61 in a plane containing the axis of the mother tube 10 and the center of each ball 13 being larger than a radius of each ball 13.

Preferably, the ball contact area 23 is formed with a second groove 62 extending in the circumferential direction of the mother tube 10, and a radius of curvature of the second groove 62 in the plane containing the axis of the mother tube 10 and the center of each ball 13. More preferably, the ball track area 15 is inversely tapered in the moving direction of the mother tube 10 at an angle ranging from 2° to 5° with respect to the axis of the mother tube 10. Further, the ball contact area 23 is inclined in the moving direction of the mother tube 10 at an angle ranging from 10° to 30° with respect to the radial direction of the mother tube 10.

By the formation of the grooves 61 and 62 on the ball track area 15 and the ball contact area 23, the balls 13 are rotated within the grooves 61 and 62 in line contact therewith during grooving. Accordingly, the local wearing of each member can be reduced to thereby eliminate the occurrence of chipping as the problem in the prior art.

In particular, by giving the above-mentioned tilt angles to the ball track area 15 and the ball contact area 23, and by giving the line contact instead of point contact to each ball contact portion, the balls can be rotated at random during grooving, thereby preventing the local wearing of each ball.

Preferably, the outer ring 14 and the thrust support member 22 are formed of ceramic, and the ball retainer 20 is formed of synthetic resin and has through holes for respectively retaining the balls 13. More specifically, the synthetic resin is polyamideimide resin. By adopting ceramic for the materials of the outer ring 14 and the thrust support member 22, the forming apparatus itself can be reduced in size and weight, and the centrifugal force generated during grooving can be reduced to thereby allow high-speed rotation. Further, by adopting synthetic resin, preferably, polyamideimide resin for the material of the ball retainer 20, the friction between the balls 13 and the ball retainer 20 during grooving can be reduced, and high durability can be exhibited even at high temperatures.

DETAILED DESCRIPTION OF THE PREFERRED EMBODIMENTS

The function and configuration of an inner grooved tube forming apparatus according to a preferred embodiment of the present invention will now be described with reference to FIGS. 1 to 3.

The function of the forming apparatus will first be described with reference to FIG. 1. FIG. 1 is a sectional view of the forming apparatus.

Figure 1:
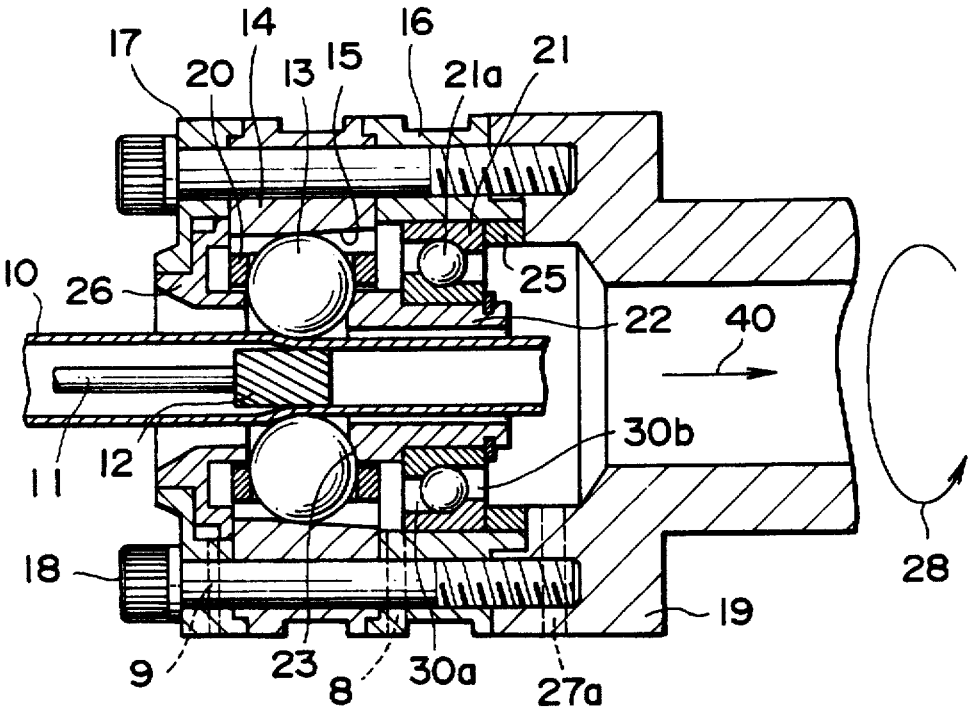
FIG. 1 is a sectional view of an inner grooved tube forming apparatus according to the present invention.

In the inner grooved tube forming apparatus shown in FIG. 1, the wall of a mother tube 10 is pressed between a grooved plug 12 inserted in the mother tube 10 and balls 13 rolling on the outer surface of the mother tube 10 to thereby transfer the shape of a groove formed on the grooved plug 12 to the inner surface of the mother tube 10. In this operation, the movement of the balls 13 in the circumferential direction of the mother tube 10 relative to an outer ring 14 (ball track retaining outer ring) is restricted by a ball retainer 20, and the balls 13 are pressed on the outer surface of the mother tube 10 in its radial direction by a ball track area 15 of the outer ring 14. An angular contact ball bearing 21 is mounted on the outer ring 14, and a thrust support member 22 is mounted on the bearing 21. The balls 13 are supported by a ball contact area 23 of the thrust support member 22. The thrust support member 22 receives a force having a direction opposite to a moving direction of the mother tube 10 from the bearing 21, so that the balls 13 are urged in the direction opposite to the moving direction of the mother tube 10. In this manner, the forces in the radial and thrust directions are applied to the balls 13 by the outer ring 14 and the thrust support member 22, and in this condition the outer ring 14 is rotated to roll the balls 13 on the outer surface of the mother tube 10 and thereby press the wall of the mother tube 10 between the balls 13 and the grooved plug 12. As a result, the shape of the groove of the grooved plug 12 is transferred to the inner surface of the mother tube 10, and the diameter of the mother tube 10 is reduced by the pressure of the balls 13. Thus, the inner surface of the mother tube 10 is grooved with the diameter of the mother tube 10 reduced, and the mother tube 10 is drawn by a device not shown, thereby obtaining an inner grooved tube.

According to the conventional shapes of the outer ring 14 and the thrust support member 22, the balls 13 come to point contact with the outer ring 14 and the thrust support member 22. As a result, there is generated a local load at each contact portion by a reaction force from the mother tube 10 and a centrifugal force of the balls 13, causing the occurrence of chipping (local defects) in the outer ring 14 and the thrust support member 22, thus shortening the life of each member. To prevent such local defects, grooves 61 and 62 extending in the circumferential direction of the mother tube 10 are respectively formed on the ball track area 15 of the outer ring 14 and on the ball contact area 23 of the thrust support member 22 according to the present invention. In consideration of a possibility that the balls 13 may be elastically deformed by the pressure of the outer ring 14 and the centrifugal force during the operation, resulting in an increase in radius of curvature of each contact portion, the radius of curvature of each of the grooves 61 and 62 in a plane containing the axis of the mother tube 10 and the center of each ball 13 is set preferably larger than the radius of each ball 13 before the operation. Accordingly, the radius of each ball 13 during the operation becomes substantially equal to the radius of curvature of each of the grooves 61 and 62, so that each ball 13 comes to line contact with each of the grooves 61 and 62. As a result, the local load can be reduced to allow elimination of the chipping. One or plural grooves may be formed correspondingly to the sizes of columns.

To prevent local wearing of each ball 13 by rotating each ball 13 at random, the ball track area 15 of the outer ring 14 is preferably tapered so as to diverge in the drawing direction of the mother tube 10, and the tapering angle of the ball track area 15 is set preferably in the range of 2° to 5° with respect to the axis of the mother tube 10. If the tapering angle is less than 2°, the ball track area 15 is substantially not tapered, but substantially parallel to the moving direction of the mother tube 10. Accordingly, in the case of changing the position of the balls 13 relative to the outer ring 14 in the moving direction of the mother tube 10, the distance between each ball 13 and the axis of the mother tube 10 is hardly changed, so that the pressure of each ball 13 to the mother tube 10 cannot be changed. If the axial length of the outer ring 14 in the moving direction of the mother tube 10 is increased to enlarge this change, the outer ring 14 and the whole of the forming apparatus becomes large in size, causing a difficulty of reduction in weight. In contrast, if the tapering angle is greater than 5°, even a slight change in position of the balls 13 relative to the outer ring 14 in the moving direction of the mother tube 10 invites a large change in distance between each ball 13 and the axis of the mother tube 10, thus causing a difficulty of fine adjustment of the pressure of each ball 13 to the mother tube 10.

Further, the ball contact area 23 of the thrust support member 22 is inclined in the drawing direction of the mother tube 10 preferably in the range of 10° to 30° with respect to the radial direction of the mother tube 10. By setting the inclination angle of the ball contact area 23 to this range, the center of planetary rotation of the balls 13 relative to the ball contact area 23 is deviated, and a rotating force is therefore applied from the ball contact area 23 to the balls 13, thereby allowing random rotation of the balls 13. As a result, the local wearing of each ball 13 can be prevented. If the inclination angle of the ball contact area 23 is less than 10°, the deviation of the center of planetary rotation of the balls 13 relative to the ball contact area 23 is small, so that the application of the rotating force to the balls 13 is insufficient. As a result, the balls 13 are rotated only in the radial direction and locally worn, so that the pressure of the balls 13 to the mother tube 10 becomes random because of deformation of the balls 13, causing formation of unevenness and pattern on the outer surface of the mother tube 10. In the case that the amount of wearing of the balls 13 is large, the shape of the groove to be formed on the inner surface of the mother tube 10 becomes defective. In contrast, if the inclination angle of the ball contact area 23 is greater than 30°, even slight wearing of the ball contact area 23 invites a large deviation of the track position of the balls 13, thus causing a reduction in pressure accuracy.

In the case that it is difficult to reduce the size and weight of the forming apparatus itself, it is necessary to select a material having a small specific gravity and a high strength as the material of each member constituting the apparatus. In the forming apparatus for the inner grooved tube, a very large centrifugal force is applied to each member with an increase in rotational speed. Therefore, the reduction in weight of each member is particularly important, and it is also essential to satisfy required characteristics inherent to each member in addition to a high strength of each member. That is, the outer ring 14 and the thrust support member 22 must have good compressive load resistance and good wear resistance. In view of this point, the outer ring 14 and the thrust support member 22 are formed of ceramic in the present invention. The specific gravity of ceramic is about ⅓ of the specific gravity of cemented carbide, so that the outer ring 14 and the thrust support member 22 in the present invention can be greatly reduced in weight. As a result, the centrifugal force can be reduced to allow high-speed rotation. Examples of such ceramic include zirconia, silicon nitride, silicon carbide, and sialon. These materials have high strength, high toughness, and high wear resistance. However, the local load resistance of ceramic is less than that of cemented carbide. Therefore, this defect is prevented by providing the curvature at each contact portion as mentioned above according to the present invention.

The ball retainer 20 functions to maintain the balls 13 on a given rotation track and also maintain the balls 13 at equally spaced positions in the circumferential direction of the mother tube 10. A conventional ball retainer formed of brass has a defect that it is rapidly worn at high temperatures by the contact with balls. It is accordingly desired to use a material having good heat resistance and high wear resistance as the material of the ball retainer. In view of this point, the ball retainer 20 in the present invention is formed of synthetic resin. The ball retainer 20 formed of synthetic resin has a self-lubricating surface and high strength at high temperatures. Further, the weight of the ball retainer 20 is about ⅕ of the weight of the conventional ball retainer formed of brass. Accordingly, the friction between the balls 13 and the ball retainer 20 can be reduced, and the life of the ball retainer 20 can be greatly extended because of its high strength at high temperatures. For example, the life of the ball retainer 20 in the present invention becomes 20 times or more the life of the conventional ball retainer formed of brass.

As an example of such synthetic resin, polyamideimide may be adopted. Polyamideimide has greatly high heat resistance so as to endue a high temperature of 250° C. Further, since polyamideimide has a self-lubricating property to reduce a frictional resistance, it is suitable for the material of the ball retainer. Other examples of the synthetic resin include fiber-reinforced resin reinforced by carbon fiber, aramid fiber, boron fiber, glass fiber, etc. Although the ball retainer in the present invention may be formed of such fiber-reinforced resin, the fiber-reinforced resin is not satisfactory in uniformity, and has a large frictional resistance.

The ball retainer 20 may have various shapes. In particular, an outer ring retained type ball retainer such that the balls are retained radially outside of a radius of rotation of the balls is preferable for high-speed rotation. Further, the ball retainer 20 is preferably formed with through holes for respectively retaining the balls 13. Usually, each through hole is formed so that the diameter of the through hole is slightly larger than the diameter of each ball 13. Accordingly, the movement of each ball 13 in the circumferential direction of the mother tube 10 can be restricted. In this manner, the position accuracy of the balls 13 can be improved by forming such through holes in the ball retainer 20 to restrict the circumferential movement of the balls 13.

The number of the balls 13 is preferably set to an odd number so that no opposed ones of the balls 13 are present. With this arrangement, a reaction force from the mother tube 10 can be reduced to thereby facilitate the rotation of the balls 13.

Further, a front cap 17 and a cylinder 16 accommodating the bearing 21 for supporting the thrust support member 22 are preferably formed with oil drain holes 8 and **27*a*, respectively, because if excess oil stays in the forming apparatus, the viscosity of the oil acts as a resistance load during high-speed rotation, causing a degradation in groove formability and a reduction in cooling effect. The oil drain holes 8 and 27*a* extend preferably radially outward of the mother tube 10 for easy drainage by the centrifugal force during the operation. The oil drain holes 8 and 27*a*** may have various shapes such as a slit shape or a cylindrical shape.

The material of the cylinder 16 for accommodating the bearing 21 and the material of the front cap 17 for fixing the outer ring 14 are preferably formed of titanium alloy for the purpose of further reduction in weight of the forming apparatus, allowing high-speed rotation.

Examples of the metal or alloy tube as the mother tube 10 used in the forming apparatus according to the present invention include a copper or copper alloy tube and an aluminum or aluminum alloy tube. As an example of the copper or copper alloy tube, a phosphorus deoxidized copper tube may be used.

The configuration of the forming apparatus realizing the above-mentioned function will now be described in detail with reference to FIGS. 1 to 3.

Figure 4:
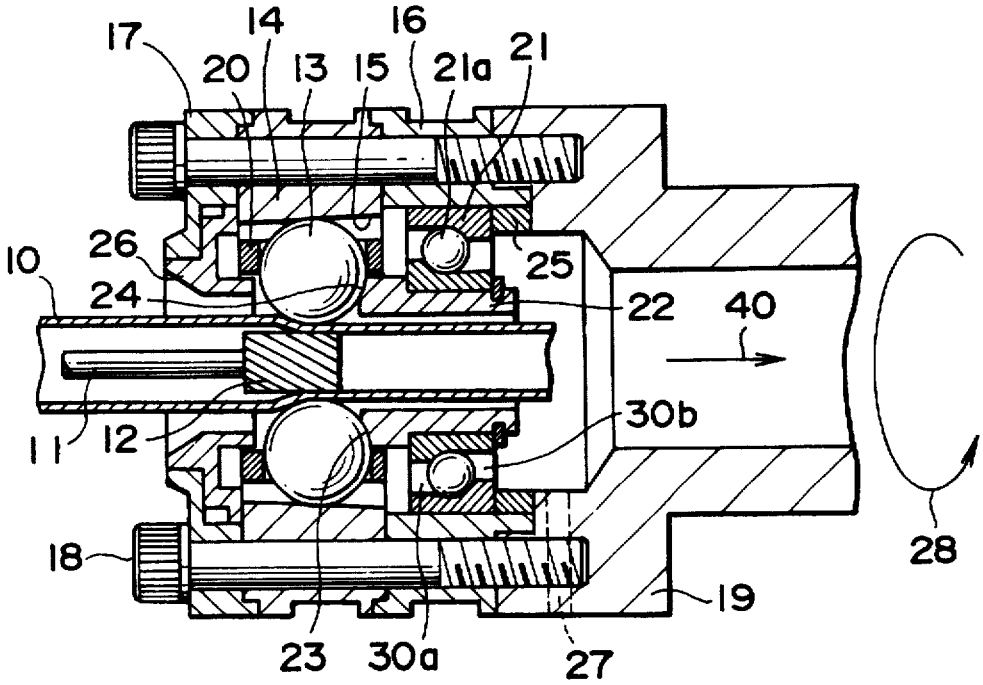
FIG. 4 is a sectional view of an inner grooved tube forming apparatus in the prior art.

In the following description, substantially the same parts as those shown in FIG. 4 will be denoted by the same reference numerals, and the detailed description thereof will be omitted herein. As shown in FIG. 1, the balls 13 are accommodated in the short cylindrical outer ring 14. The tapering ball track area 15 is formed on the inner surface of the outer ring 14 so as to diverge in the direction of the arrow 30. The outer ring 14 is formed of ceramic such as zirconia. The outer ring 14 is fixed through the cylinder 16 and the front cap 17 to the rotating shaft 19. The cylinder 16 and the front cap 17 are formed of titanium alloy having a light weight and a high strength (JIS 4607). The ball retainer 20 is accommodated in the outer ring 14. The ball retainer 20 is formed of polyamideimide having an excellent self-lubricating property and a high strength at high temperatures. The ball retainer 20 is formed with through holes for respectively retaining the balls 13 in the radially inward direction of the mother tube 10. The cylinder 16 is fixed to the outer ring 14 by bolts 18. The angular contact ball bearing 21 is mounted inside the cylinder 16. The substantially cylindrical thrust support member 22 is rotatably supported through the bearing 21 to the cylinder 16. The thrust support member 22 is formed of ceramic such as zirconia.

Figure 2:
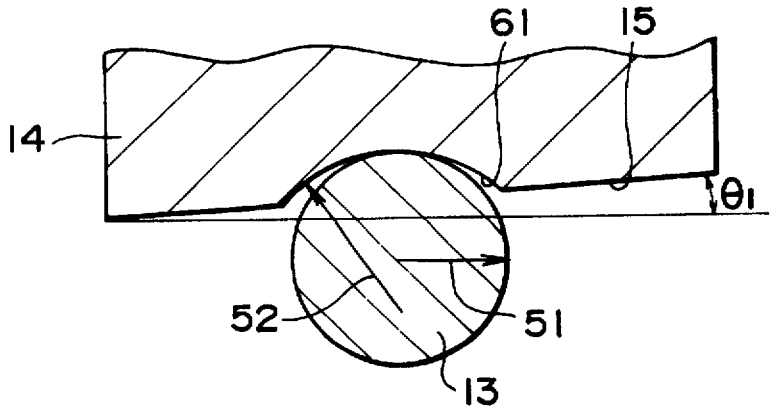
FIG. 2 is an enlarged sectional view of a ball track area.

FIG. 2 is an enlarged sectional view of the ball track area 15 of the outer ring 14. As shown in FIG. 2, the groove 61 is formed on the ball track area 15 so as to extend in the circumferential direction of the mother tube 10. The radius 52 of curvature of the groove 61 in a plane containing the axis of the mother tube 10 and the center of each ball 13 is set larger by about 10% than the radius 51 of each ball 13. The groove 61 functions to relax an impact load applied from each ball 13 to the outer ring 14 at starting the operation. Further, the tapering angle $\theta_1$ of the ball track area 15 shown in FIG. 2 is set in the range of 2° to 5°. In the case that the tapering angle $\theta_1$ is set to 2°, for example, tan2°= 0.03492, so that when the thickness of the spacer 25 is changed by 1 mm, the distance between each ball 13 and the axis of the mother tube 10 (the pressure of each ball 13 to the mother tube 10) changes by 0.0349 mm. Accordingly, in the case of adjusting the above distance in steps of 0.005 mm, the thickness of the spacer 25 is changed in steps of 0.143 mm.

Figure 3:
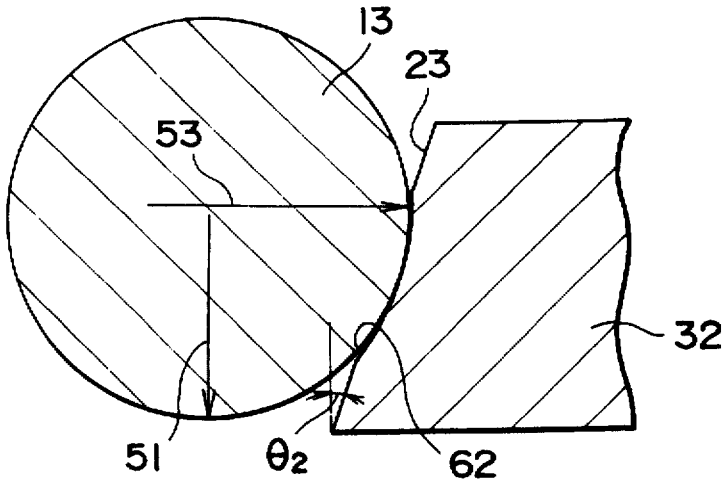
FIG. 3 is an enlarged sectional view of a ball contact area.

FIG. 3 is an enlarged sectional view of the ball contact area 23 of the thrust support member 22. As shown in FIG. 3, the groove 62 is formed on the ball contact area 23 so as to extend in the circumferential direction of the mother tube 10. The radius 63 of curvature of the groove 62 in the plane containing the axis of the mother tube 10 and the center of each ball 13 is set larger by about 10% than the radius 51 of each ball 13. The ball contact area 23 is inclined in the direction of the arrow 40 shown in FIG. 1 with respect to the radial direction of the mother tube 10. The inclination angle $\theta_2$ of the ball contact area 23 shown in FIG. 3 is set in the range of 10° to 30°.

The supply of a lubricating oil to the balls 13 and the bearing 21 is performed by using an oil circulating device (not shown) to spray the lubricating oil along the mother tube 10. At this time, an excess amount of oil is supplied to the balls 13, the ball track area 15, the thrust support member 22, and the bearing 21 for the purpose of cooling. If the excess amount of oil supplied is not drained, the groove formation on the mother tube 10 is hindered by the viscous resistance of the oil, and solid matter contained in the oil is deposited by high-speed rotation. To prevent this deposition and drain the excess oil, the cylinder 16 is formed with a slit 8 extending in the radial direction of the mother tube 10, and the front cap 17 is formed with a through hole 9 extending in the radial direction of the mother tube 10. Further, the guide cap 26 is also formed with four drain holes (not shown) arranged along the circumferential direction of the mother tube 10. Accordingly, the oil passed through the drain holes of the guide cap 26 is drained through the through hole 9 to the outside of the apparatus. Similarly, the rotating shaft 19 is formed with a drain hole 27*a* extending in the radial direction of the mother tube 10. Accordingly, the excess oil is drained through the slit 8, the through hole 9, and the drain hole 27*a* by the centrifugal force generated during the operation.

While the grooved plug 12 is formed with a spiral groove in this preferred embodiment, the grooved plug 12 may be formed with straight grooves.

The operation of the forming apparatus for the inner grooved tube mentioned above will now be described. First, the mandrel 11 is operated to insert the grooved plug 12 fixed to the front end of the mandrel 11 into the mother tube 10. The wall of the mother tube 10 is pressed between the grooved plug 12 inside of the tube 10 and the balls 13 outside of the tube 10, and the balls 13 are rotated about the axis of the tube 10 as rolling on the outer surface of the tube 10. At the same time, the mother tube 10 is drawn in the direction of the arrow 40. At this time, the movement of the balls 13 in the circumferential direction of the mother tube 10 relative to the outer ring 14 is restricted by the ball retainer 20, and the balls 13 are pressed in the radial direction of the mother tube 10 by the ball track area 15. Further, the rear end of the angular contact ball bearing 21 is tilted so as to come away from the mother tube 10 during the operation, thereby pressing the thrust support member 22 in a direction opposite to the drawing direction of the mother tube 10. As a result, a force having a direction opposite to the drawing direction of the mother tube 10 is applied from the ball contact area 23 of the thrust support member 22 to the balls 13. Thus, the balls 13 receive the forces having different directions from the outer ring 14 and the thrust support member 22. In such a pressed condition of the balls 13, the rotating shaft 19 is rotated to rotate the outer ring 14, thereby rolling the balls 13 on the outer surface of the mother tube 10 and simultaneously revolving the balls 13 around the mother tube 10 under the condition that the wall of the mother tube 10 is pressed between the balls 13 and the grooved plug 12. As a result, the shape of the groove of the grooved plug 12 is transferred to the inner surface of the mother tube 10, and the diameter of the mother tube 10 is reduced by the pressure of the balls 13. In this manner, the mother tube 10 is grooved with its diameter reduced, and is moved in the drawing direction to obtain an inner grooved tube having a continuous groove from the mother tube 10.

Conventionally, the outer ring 14 and the thrust support member 22 are in point contact with the balls 13, so that the outer ring 14 and the thrust support member 22 are required to have high strength and high durability. Therefore, the outer ring 14 and the thrust support member 22 in the prior art are formed of cemented carbide. Further, the ball retainer 20 in the prior art is formed of brass, which has a small contact resistance, and the other members are formed of heat-treated alloy iron. Since these materials have large specific gravities, there occurs fracture at high rotating speeds of 40000 rpm or more, or the quality of the product becomes unstable because of local wearing in the prior art. Further, the reduction in size of the apparatus has reached a limit.

According to this preferred embodiment, the outer ring 14 and the thrust support member 22 are formed of ceramic, thereby reducing the specific gravity to about ⅓ of that in the prior art. Accordingly, the outer ring 14 and the thrust support member 22 can be reduced in weight to thereby reduce the centrifugal force during the operation and accordingly allow high-speed rotation.

Further, since the conventional ball retainer is formed of brass, it is heavy, and the strength at high temperatures due to heat generation by friction is reduced to cause rapid proceeding of wearing. According to this preferred embodiment, the ball retainer 20 is formed of polyamideimide, which has a good self-lubricating property and a high strength at high temperatures. Accordingly, as compared with the weight of the conventional ball retainer formed of brass, the weight of the ball retainer 20 in this preferred embodiment can be reduced to about ⅕. Further, owing to the self-lubricating property, the friction between the balls 13 and the ball retainer 20 can be reduced. Owing to this effect and the high strength at high temperatures, the life of the ball retainer 20 can be extended to 20 times or more the life of the conventional ball retainer formed of brass. Further, since the balls 13 are maintained at equal intervals in the circumferential direction of the mother tube 10 by the ball retainer 20, pressing ripples on the product can be reduced to obtain a greatly smooth outer surface.

To realize the rotation at high speeds of 40000 rpm or more in the present invention, the cylinder 16 and the front cap 17 are formed of titanium alloy having high strength, instead of heat-treated steel used in the prior art. Accordingly, the cylinder 16 and the front cap 17 can be reduced in weight to the half as compared with the prior art. As a result, the weight of the forming apparatus as a whole can be reduced to the half as compared with the prior art.

Furthermore, the tapering angle of the ball track area 15 is set in the range of 2° to 5°, and the inclination angle of the ball contact area 23 is set in the range of 10° to 30°. With this setting, rotating forces are applied from these areas 15 and 23 to each ball 13, thereby changing the rotation track of the balls 13. As a result, the local wearing of the balls 13 can be prevented to allow stable formation of the groove on the mother tube 10.

Furthermore, the radius of curvature of the groove 61 of the outer ring 14 and the radius of curvature of the groove 62 of the thrust support member 22 are set larger than the radius of each ball 13, so as to make line contact of each ball 13 with the grooves 61 and 62. Accordingly, the local load to the outer ring 14 and the thrust support member 22 can be reduced to thereby prevent the occurrence of chipping of the outer ring 14 and the thrust support member 22. As a result, the life of the outer ring 14 and the thrust support member 22 both formed of ceramic can be extended. In addition, since the contact portions between each ball 13 and the ball track area 15 of the outer ring 14 and between each ball 13 and the ball contact area 23 of the thrust support member 22 can be increased in area, thereby increasing the rotating force to each ball 13. As a result, the local wearing of each ball 13 can be reduced to thereby allow stable formation of the groove on the inner surface of the mother tube 10 over a long period of time.

Further, since the slit 8 is formed in the cylinder 16 and the through hole 9 is formed in the front cap 17 according to this preferred embodiment, the deposition of solid matter contained in the oil due to high-speed rotation can be prevented to thereby allow smooth formation of the groove.

With the above effects, the weight of the forming apparatus as a whole can be reduced to the half as compared with the prior art, thereby reducing a mass radius. As a result, the centrifugal force in this preferred embodiment can be reduced to ¼ or less of that in the prior art with the same size and the same rotating speed. Accordingly, the grooving can be allowed at high rotating speeds of 60000 rpm or more. Further, since the rotation track of the balls 13 varies at random, the local wearing of each ball 13 can be reduced, and the friction between the balls 13 and the ball retainer 20 can be reduced. In addition, the reduction in weight of the forming apparatus as a whole allows a reduction in centering deviation, thereby obtaining a good surface condition of the product tube. Accordingly, the number of times of adjustment of the dimensions of the groove formed on the inner surface of the tube can be reduced to improve a contact rate (operation rate).

In a test actually using the inner grooved tube forming apparatus according to this preferred embodiment to form a groove on the inner surface of a copper tube, the grooving could be performed at a high rotating speed of 50000 rpm. As a result, a groove forming speed was improved by 25% as compared with the prior art. Further, since the life of each member was extended and the quality therefore became stable, the number of times of adjustment of the forming apparatus was reduced and the productivity was therefore improved by 35% or more as compared with the prior art. Although the rotating speed of the forming apparatus was increased and the drawing speed of the mother tube was increased, the life of the outer ring 14 and the thrust support member 22 was extended to two or three times the life of conventional members formed of cemented carbide. Further, the life of the ball retainer 20 was extended to 20 times or more the life of a conventional member formed of brass.

As described above, according to the present invention, the ball track retaining outer ring and the thrust support member are formed of ceramic, and the ball retainer is formed of synthetic resin. Accordingly, high-speed rotation is allowed, thereby improving the efficiency of grooving of the inner surface of the mother tube, and improving the durability of the tool. Thus, an inner groove tube with a stable quality can be manufactured.

What is claimed is:

1. An inner grooved tube forming apparatus comprising:

a grooved plug adapted to be inserted into a mother tube;

a ball track retaining outer ring through which said mother tube is inserted, said outer ring having an inner surface formed as a ball track area;

a plurality of balls kept in contact with an outer surface of said mother tube and said ball track area, and adapted to be rolled on said outer surface of said mother tube as being rotated around said mother tube by rotation of said outer ring, whereby a wall of said mother tube is pressed between said balls and said grooved plug to transfer a shape of a groove formed on said grooved plug to an inner surface of said mother tube;

a ball retainer accommodated in said outer ring, for retaining said balls at a radial position outside of a rotation track of the center of each ball in a radial direction of said mother tube; and a thrust support member rotatably supported by a bearing mounted inside said outer ring, said thrust support member having a ball contact area kept in contact with said balls, for applying to said balls a force having a direction opposite to a moving direction of said mother tube;

wherein said ball track area is formed with a first groove extending in a circumferential direction of said mother tube, a radius of curvature of said first groove in a plane containing the axis of said mother tube and the center of each ball being larger than a radius of each ball.

2. An inner grooved tube forming apparatus according to claim 1, wherein said ball contact area is formed with a second groove extending in the circumferential direction of said mother tube, a radius of curvature of said second groove in the plane containing the axis of said mother tube and the center of each ball being larger than the radius of each ball.

3. An inner grooved tube forming apparatus according to claim 2, wherein said ball track area is inversely tapered in the moving direction of said mother tube at an angle ranging from 2° to 5° with respect to the axis of said mother tube.

4. An inner grooved tube forming apparatus according to claim 3, wherein said ball contact area is inclined in the moving direction of said mother tube at an angle ranging from 10° to 30° with respect to the radial direction of said mother tube.

5. An inner grooved tube forming apparatus according to claim 2, wherein said ball contact area is inclined in the moving direction of said mother tube at an angle ranging from 10° to 30° with respect to the radial direction of said mother tube.

6. An inner grooved tube forming apparatus according to claim 1, wherein said ball track area is inversely tapered in the moving direction of said mother tube at an angle ranging from 2° to 5° with respect to the axis of said mother tube.

7. An inner grooved tube forming apparatus according to claim 6, wherein said ball contact area is inclined in the moving direction of said mother tube at an angle ranging from 10° to 30° with respect to the radial direction of said mother tube.

8. An inner grooved tube forming apparatus according to claim 1, wherein said ball contact area is inclined in the moving direction of said mother tube at an angle ranging from 10° to 30° with respect to the radial direction of said mother tube.

9. An inner grooved tube forming apparatus according to claim 1, wherein said outer ring and said thrust support member are formed of ceramic, and said ball retainer is formed of synthetic resin and has through holes for respectively retaining said balls.

10. An inner grooved tube forming apparatus according to claim 9, wherein said synthetic resin is polyamideimide resin.

11. An inner grooved tube forming apparatus according to any one of claims 1 to 4, further comprising a front cap fixed to said outer ring, for restricting movement of said outer ring in a longitudinal direction of said mother tube, said front cap being formed with an oil drain hole.

12. An inner grooved tube forming apparatus according to any one of claims 1 to 4, further comprising a cylinder for accommodating said bearing, said cylinder being formed of titanium alloy.

13. An inner grooved tube forming apparatus according to any one of claims 1 to 4, further comprising a rotating shaft for transmitting a driving force from driving means to said outer ring, and a front cap for fixing said outer ring to said rotating shaft, said front cap being formed of titanium alloy.

14. An inner grooved tube forming apparatus comprising:

a grooved plug adapted to be inserted into a mother tube;

a ball track retaining outer ring through which said mother tube is inserted, said outer ring having an inner surface formed as a ball track area;

a plurality of balls kept in contact with an outer surface of said mother tube and said ball track area, and adapted to be rolled on said outer surface of said mother tube as being rotated around said mother tube by rotation of said outer ring, whereby a wall of said mother tube is pressed between said balls and said grooved plug to transfer a shape of a groove formed on said grooved plug to an inner surface of said mother tube;

a ball retainer accommodated in said outer ring, for retaining said balls at a radial position outside of a rotation track of the center of each ball in a radial direction of said mother tube; and a thrust support member rotatably supported by a bearing mounted inside said outer ring, said thrust support member having a ball contact area kept in contact with said balls, for applying to said balls a force having a direction opposite to a moving direction of said mother tube;

wherein said ball track area is formed with a first groove extending in a circumferential direction of said mother tube, a radius of curvature of said first groove in a plane containing the axis of said mother tube and the center of each ball being larger than a radius of each ball;

said ball contact area is formed with a second groove extending in the circumferential direction of said mother tube, a radius of curvature of said second groove in the plane containing the axis of said mother tube and the center of each ball being larger than the radius of each ball;

said ball track area is inversely tapered in the moving direction of said mother tube at an angle ranging from 2° to 5° with respect to the axis of said mother tube;

said ball contact area is inclined in the moving direction of said mother tube at an angle ranging from 10° to 30° with respect to the radial direction of said mother tube; and said outer ring and said thrust support member are formed of ceramic, and said ball retainer is formed of synthetic resin and has through holes for respectively retaining said balls.

* * * * *